US012729535B2

(12) United States Patent
Rubio Alonso et al.

(10) Patent No.: US 12,729,535 B2
(45) Date of Patent: Sep. 8, 2026

(54) LAYERED PANEL AND METHOD OF CONSTRUCTION THEREOF

(71) Applicants: ABB Schweiz AG, Baden (CH); Oscar Rubio Alonso, Cabrils (ES)

(72) Inventors: Oscar Rubio Alonso, Cabrils (ES); Jordi Ribatallada, Sant Quirze del Valles (ES); Cristobal Vela, Sant Quirze del Valles (ES)

(73) Assignees: ABB Schweiz AG, Baden (CH); Oscar Rubio Alonso, Cabrils (ES)

( * ) Notice: Subject to any disclaimer, the term of this patent is extended or adjusted under 35 U.S.C. 154(b) by 441 days.

(21) Appl. No.: 18/247,503

(22) PCT Filed: Oct. 1, 2021

(86) PCT No.: PCT/EP2021/077093

§ 371 (c)(1),
(2) Date: Mar. 31, 2023

(87) PCT Pub. No.: WO2022/069706

PCT Pub. Date: Apr. 7, 2022

(65) Prior Publication Data

US 2024/0229461 A1 Jul. 11, 2024
US 2025/0290315 A2 Sep. 18, 2025

(30) Foreign Application Priority Data

Oct. 2, 2020 (EP) ..... 20382880

(51) Int. Cl.
*E04C 2/18* (2006.01)
*E04C 2/38* (2006.01)
*E04G 21/14* (2006.01)

(52) U.S. Cl.
CPC ..... *E04C 2/18* (2013.01); *E04C 2/384* (2013.01); *E04G 21/14* (2013.01)

(58) Field of Classification Search
CPC ..... E04C 2/18; E04C 2/384
See application file for complete search history.

(56) References Cited

U.S. PATENT DOCUMENTS 3,103,254 A * 9/1963 Stedman ..... B28B 5/021 425/73
3,736,715 A * 6/1973 Krumwiede ..... E04C 2/384 52/404.1

(Continued)

FOREIGN PATENT DOCUMENTS

CN 203049907 U 7/2013
CN 109678415 A 4/2019

(Continued)

OTHER PUBLICATIONS

International Search Report and written opinion for International Application No. PCT/EP2021/077093, dated Oct. 2, 2022, 9 pages.

(Continued)

*Primary Examiner* — Brian E Glessner
(74) *Attorney, Agent, or Firm* — McCarter & English, LLP; Michael M. Gnibus

(57) ABSTRACT

Described herein is a layered panel for on-site modular construction of buildings. The layered panel includes a layer formed by a prefabricated cement-bonded particle board, a supporting structure and fastening elements attaching the prefabricated cement-bonded particle board to the supporting structure. Also described herein is a method for manufacturing the layered panel, an installation for manufacturing the layered panel and a method for the construction of buildings with a plurality of the layered panels.

12 Claims, 3 Drawing Sheets

(56) References Cited

U.S. PATENT DOCUMENTS

| | | | | |
|---|---|---|---|---|
| 5,335,472 | A * | 8/1994 | Phillips | E04C 3/44<br>D25/138 |
| 8,490,355 | B2 * | 7/2013 | Walker | B32B 21/042<br>52/302.1 |

FOREIGN PATENT DOCUMENTS

| | | | | |
|---|---|---|---|---|
| EP | 2458105 | A2 * | 5/2012 | E04C 2/38 |
| EP | 2851482 | A1 * | 3/2015 | B32B 3/085 |
| FR | 749177 | A | 7/1933 | |
| GB | 1407770 | A | 9/1975 | |
| WO | 2012136860 | A1 | 10/2012 | |

OTHER PUBLICATIONS

Extended European search report for European Application No. 20382880.1, dated Feb. 3, 2023, 7 pages.

* cited by examiner

LAYERED PANEL AND METHOD OF CONSTRUCTION THEREOF

CROSS-REFERENCE TO RELATED APPLICATIONS

This application is a National Stage Entry of International Patent Application No. PCT/EP2021/077093, filed Oct. 1, 2021 and titled "LAYERED PANEL AND METHOD OF CONSTRUCTION THEREOF", which claims priority to European Patent Application No. 20382880.1, filed Oct. 2, 2020 and titled "LAYERED PANEL AND METHOD OF CONSTRUCTION THEREOF", which are hereby incorporated by reference in their entirety.

BACKGROUND

In building construction, large amounts of high-energy produced heavy materials are used, manufactured from raw materials (such as stone, bricks, cement, mortar, etc. . . . ) that result in high transport cost and generate a lot of waste.

Alternatives to such building techniques for outer walls and facades are the use of prefabricated concrete walls, which are handled with a crane to be vertically inserted between pillars, or the use of a light metal structure on which panels of different materials are then applied, covered with mortar and painted. In all cases, the construction process still requires skilled workforce and several finishing operations, the provision of installations such as plumbing, electricity, etc.

The use of construction panels which are built by assembling a plurality of layers is described in WO2012/136860. In this document, panels are manufactured by combining a metal frame and a plurality of layers with have a specific function, with a wood layer and a layer made of cast or projected mortar. Such a panel greatly simplifies the construction of a building, and is particularly useful e.g., in remote locations, as it does not require skilled operators for the construction.

However, the manufacturing of the panel itself requires some operations that are time consuming and require heavy equipment. For example, the mortar layer must be provided evenly across the whole panel and must be safely attached to the adjacent layer, and in practice the formation of this layer requires providing a metal mesh attached in multiple points all across the adjacent layer, providing machinery to project the mortar all across the layer as the mortar is mixed, and at the same time operating a vibrator to evenly distribute the mortar. Furthermore, additional finishing layers for the outermost and innermost surfaces of the panel are usually required.

It has now been found that the properties of the panel itself may be improved, and at the same time its manufacturing process may be simplified and more easily adapted to the desired layout of each building.

Document FR 749177 relates to a method of manufacturing artificial wood and artificial wood objects for using inexpensive wood waste, such as sawdust and wood powder or flour. Also, document GB1407770 relates to a fire-resistant sound-absorbent laminated building panel.

BRIEF DESCRIPTION

According to a first aspect, a layered panel for on-site modular construction of buildings is provided, the layered panel including:

a layer formed by a prefabricated cement-bonded particle board;

a supporting structure including a perimeter frame and a metal grid, the perimeter frame being configured to receive and surround the cement-bonded particle board; and fastening elements attaching the cement-bonded particle board to the supporting structure.

According to the present disclosure, a cement-bonded particle board (CBPB from now on) is a wood composite board including wood particles or other natural fibers (such as hemp or flax) and a mineral bonding agent (e.g., Portland cement).

CBPBs are already used as finishing layers in normal building construction (usually as floorboards or ceiling boards), or as sound dampening layers in ceilings, to lower the noise level in a room. However, in the prior art, CBPBs are not used as part of a structural element of a building, which has to sustain levels of tension or weight within the structure of a building.

When used in a panel as a structural element of a building, assembled with a supporting structure having a perimeter frame and a metal grid, the CBPB may respond better to tensions or weight changes in the overall structure of the building, while other structural layers (such as a dry-mortar layer) would be more prone to cracks or fissures which may affect the overall stability of the building's structure.

At the same time, the manufacturing of the layered panel disclosed above is easier and cheaper than that of the panels of the state of the art, requiring less equipment: in particular, there is no need for equipment to project mortar as a structural element of the panel. Manufacturing of the panel is therefore possible on a construction site. Furthermore, the use of the panel for on-site modular construction, regardless of its manufacturing site, simplifies the construction of buildings, making it faster and more cost-effective than constructions using previously known panels.

More specifically, according to the present disclosure, a cement-bonded particle board (CBPB) is a wood composite board including wood particles or other natural fibers (such as hemp or flax) and a mineral bonding agent (e.g., Portland cement). The multi-layered fiber structure of CBPBs makes them lighter, thinner and ultimately stronger than dry mortar layers. Also, such boards are wear and impact resistant, while also being resistant to temperature and moisture fluctuations caused by weather conditions, for example suitable for being exposed outdoors without the need for an additional treatment or finishing. Furthermore, they are flame resistant (usually fire class A2), frost resistant, insect and fungal resistant, and do not contain substances hazardous to health. Furthermore, they provide a good sound insulation when installed in walls or other construction elements. The properties of CBPBs make the layered panels disclosed herein highly versatile.

Also, prefabricated CBPBs may be easily manufactured with a smooth finish, which makes the boards adequate to be a "finishing" layer even inside a building, i.e., they may form the outer layer and/or the inner layer of the panel, e.g., of a building wall.

A plurality of panels for a specific building or a series of similar or identical buildings may be manufactured with a simple process. Furthermore, according to an example, the supporting structures of all the panels for a building may be substantially identical. Also, the prefabricated cement-bonded particle boards may be cut to a specific design and size (i.e., some boards being pre-cut to define a door or a window), to be adapted to the desired layout of a wall, thus enabling to be disposed within the perimeter frame and then fastened to the supporting structure, without the need to use mortar and/or other types of binding pastes. The CBPB may be cut in small panels, large panels or even corrugated sheets, with no risk of bending or cracking due to big dimensions or uneven surfaces such as a corrugated one. In an example, if two or more prefabricated boards are assembled to form a layer of a panel, they may be joined to each other by means of a tongue-and-groove system.

The supporting structure may include metal elements, such as a metal grid including a plurality of ribs, for example tubular ribs, arranged with a predetermined layout, such as forming a grid across the supporting structure in order to reinforce it. Furthermore, the supporting structure may also include a perimeter frame such as, for example, a plurality of metal profiles with an L-shaped cross section forming said perimeter frame. The ribs of the metal grid may be attached to each other by, for example, welding. Furthermore, the metal grid and the perimeter frame may be attached to each other by fastening means. Alternatively, they may be welded to each other.

The assembly of the layers of the panel may be performed by means of fastening elements which may be fairly common, and which may be handled by non-specialized labor force or by automated robots. For example, the fastening elements may attach the CBPB to the supporting structure by threading. Furthermore, for example, the fastening elements may be inserted through holes in the supporting structure and threaded into the CBPB. In an example, the CBPB may be threaded to the metal grid (for example, the ribs of the metal grid), the perimeter frame, or both, and they may be, for example, screws, anchor bolted fasteners, or other type of clasping elements. In the case of using screws, the material of the prefabricated CBPB is suitable to receive a thread forming screw, for example a self-tapping or self-drilling screw, to be attached in a secure way to other layers and/or parts of the structure itself.

According to another example, the panel may include an outermost layer and an innermost layer on opposite sides of the supporting structure, and furthermore, the cement bonded particle board may be placed on the outermost layer of the panel.

Other layers may be added to the outermost layer of the panel. For example, an oriented strand board (OSB) may be added to the outermost layer of the panel. An OSB is a type of engineered wood board similar to a particle board, formed by adding adhesives and then compressing layers of wood strands (i.e., flakes) in specific orientations. OSBs have mechanical properties that make them particularly suitable for load-bearing applications in construction. It is both used as structural layers and for exterior wall applications, such as sheathing in walls, flooring, and roof decking. In exterior applications, OSBs may be fabricated with a radiant-barrier layer pre-laminated to one side. This eases installation and increases energy performance of the building envelope.

According to another example of the present disclosure, the innermost layer of the panel may further include at least one insulating layer. Such layer may be, for example, a thermal bridge break layer.

According to another example of the present disclosure, the innermost layer of the panel overlaps only partially with the supporting structure and the outermost layer. Furthermore, in an example, the innermost layer may have a smaller surface area than the outermost layer such that it overlaps a central portion of the supporting structure and the outermost layer, while at least two side strips of the supporting structure and the outermost layer remain exposed. This way, the panel may be thinner in the two side strips in order to, for example, correspond to a pillar of a building structure, in such a way that the panel may fit and be attached to the pillar when forming a building.

According to an example, the panel may also include mounting brackets attached to the supporting structure (for example, screwed to the metal grid) in correspondence with the exposed side strips. Such mounting brackets may be used to attach the panel to a pillar by, for example, screwing the bracket to a hole therein.

Due to the provision of the CBPB, the manufacturing speed of a panel as disclosed herein is increased, since there is no drying time due to the use of mortar or binding paste. Also, the manufacturing is simplified, and it may be performed on a building site in a much easier way.

The improvement of the panel itself by making it lighter and more versatile, the simplification of its manufacturing process and a higher adaptability to the layout of each wall of each individual building or series of buildings, makes it a very convenient product, especially in situations wherein a construction needs to be completed fast and with a minimum cost, and especially in remote locations.

Also, according to an example, the CBPB layer may be a single piece with a shape and dimension to fit the perimeter frame, cut to a specific predesigned layout (e.g., with an opening for a window), thus simplifying the assembly of the panel and making it more robust and cost-effective (there is no need to cut, assemble and join together several pieces according to a custom layout).

According to an example, at least part of the metal grid may include hollow tubular members filled with an insulation and fire-resistant material, which may be a vacuum-manufactured expanded polystyrene bar.

The use of vacuum-manufactured expanded polystyrene bars in several hollow tubular members of the metal grid may render the overall metal grid resistant to fire, or, if the metal grid is formed completely by hollow members filled with such bars, practically incombustible. It may also prevent the flow of air (and thus a temperature exchange along the structure) and, at the same time, improve acoustic insulation through the panel. It is also a simpler and more cost-effective method than, for example, applying a standard spray gypsum-based plaster or similar fireproofing substance on the structure's surface.

Furthermore, the panel may also include tubing and tubing connectors for water installations and/or electrical installations and/or heating installations, which may be arranged, for example, built-in in a specific layer included within the innermost layer of the panel. Such layer may include grooves configured to receive cables and pipes along its surface. Another example may be the layer being defined by a space between two layers, the cables and pipes being attached to the inner surface of any of those layers, thus being installed between the two.

In addition, the disclosed panels may be used for on-site modular construction of buildings. Such modular construction may be achieved by attaching a plurality of panels to a building's metal structure including pillars and beams, the pillars and beams being connected by, for example, connection blocks, and wherein part of the beams and pillars may include connection plates with openings for the attachment of the panels, which will form the walls of the building, to the beams, such attachment being made by, for example, threading fastening means such as screws. The panels may be attached to the pillars by using, for example, the previously described mounting brackets.

According to another aspect of the present disclosure, a method is presented for manufacturing a layered panel as previously disclosed, the method including:

- manufacturing a supporting structure including a metal grid and a perimeter frame;
- cutting a prefabricated cement-bonded particle board according to a predetermined layout;
- assembling the cut cement-bonded particle board inside the perimeter frame of the manufactured supporting structure and fastening the cement-bonded particle board to the manufactured supporting structure.

According to another aspect of the present disclosure, an installation is presented for manufacturing a layered panel as previously disclosed, the installation including:

- a station to form a supporting structure including a metal grid and a perimeter frame;
- a station for cutting a prefabricated cement-bonded particle board according to a predetermined layout; and
- a station to receive a supporting structure and a prefabricated cement-bonded particle board from the previous stations, and for assembling the cement-bonded particle board inside the perimeter frame of the supporting structure and fastening the board to the supporting structure.

According to an example, the metal grid of the supporting structure as previously described may include hollow tubular members and the station to form a supporting structure may further include a unit for inserting a vacuum-manufactured expanded polystyrene bar inside a hollow tubular member of the metal grid. This way, the hollow members may be filled with prefabricated polystyrene bars previously cut, depending on the requirements of the structure of each panel to be manufactured.

According to another aspect, a method is presented for the construction of buildings with layered panels as previously described, the method including:

- erecting a building skeleton including load-bearing columns and beams: and
- forming at least outer walls of the building by attaching layered panels as previously described, to columns and/or beams of the skeleton, and optionally to other panels, with screws and/or rivets.

Furthermore, according to an example, the method for the construction of buildings may further include:

- arranging an installation, as previously described, for manufacturing a layered panel, in shipping containers;
- transporting the shipping containers to a desired building site;
- deploying the stations of the installation from the shipping containers at the desired building site;
- operating the stations of the installation to manufacture layered panels; and
- constructing buildings with the layered panels at the desired building site.

According to another example, at least one station of the installation is arranged inside one container according to an operational layout, whereby the station may be substantially deployed by removing at least part of the container walls.

BRIEF DESCRIPTION OF THE DRAWINGS

Non-limiting examples of the present disclosure will be described in the following, with reference to the appended drawings, in which.

DETAILED DESCRIPTION

Figure 1:
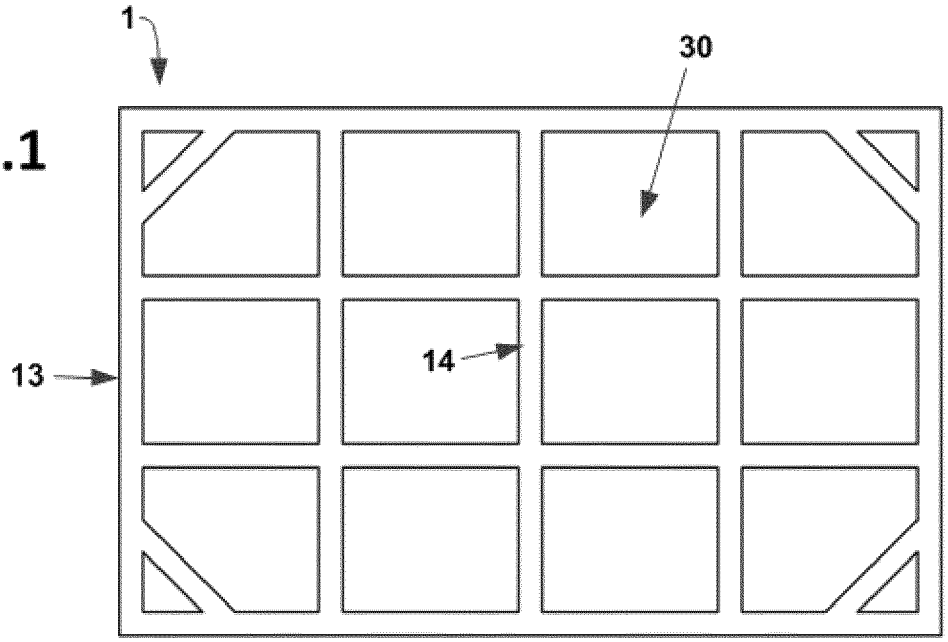
FIG. 1 shows the supporting structure of an example of a panel according to the present disclosure.

FIG. 1 shows a supporting structure 1, according to an example of the disclosed layered panel. More specifically, the panel includes a supporting structure 1 including a perimeter structure 13 and a plurality of ribs 14, both the perimeter structure and the ribs formed by hollow metal bars, and forming a metal grid according to a predesigned layout of the panel. As a result, the metal grid formed by the perimeter structure 13 and the ribs 14 also forms hollow spaces 30 in between them.

Figure 2:
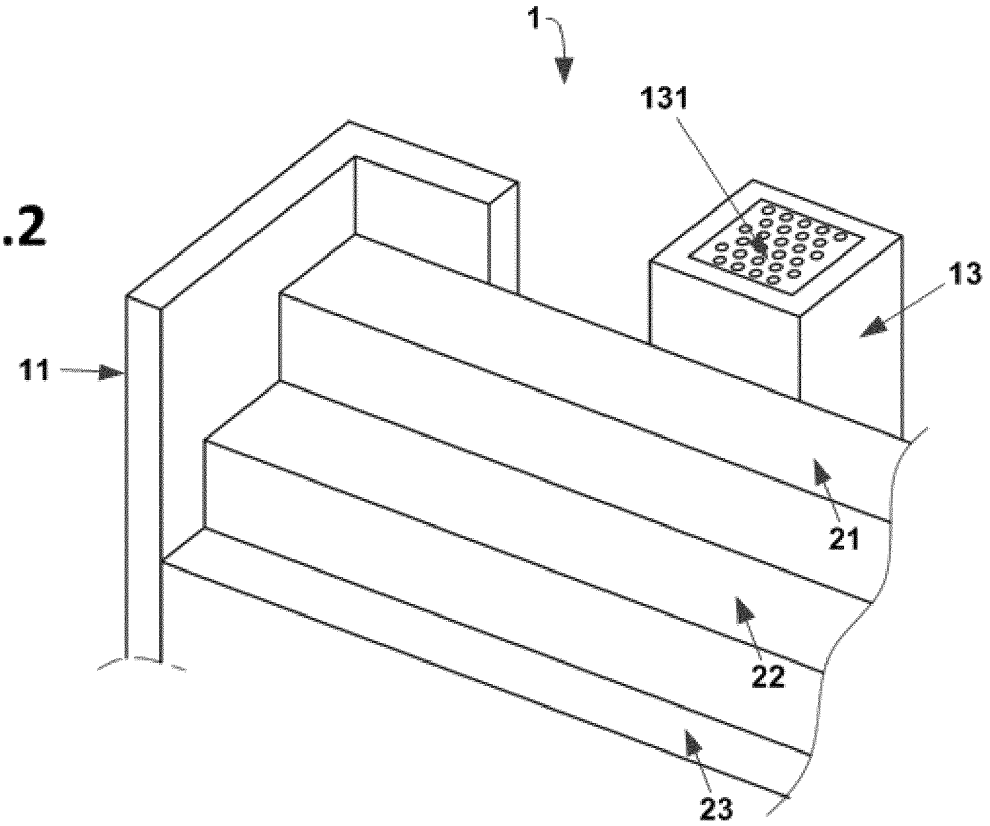
FIG. 2 shows a perspective view, partly cut away, of an example of a partially assembled panel according to the present disclosure.

FIG. 2 shows in perspective a portion of the panel partly cut out, to show the supporting structure 1, layers and other elements found therein. More specifically, the outer portion of the panel, e.g., of a building wall, is illustrated. In this example, the supporting structure 1 further includes a perimeter frame 11 with an L-shaped profile configured to receive a plurality of layers of the panel.

According to this example, the following layers are assembled on and attached to the perimeter frame 11, in order to form the outer portion of the panel, e.g., of a building wall: an oriented strand board (OSB from now on) 21, a thermal bridge break layer 22, and a CBPB 23. An upper portion of each of layers 21, 22 and 23 is cut out in FIG. 2, so that all the layers are visible in the perspective view.

In any of the embodiments of the panel disclosed herein, the CBPB may be the outer structural layer of the panel: for example, the exposed structural layer on the outside of a building that is built using panels according to the present disclosure.

Furthermore, the hollow metal bars forming the perimeter structure 13 and the ribs 14 are filled by prefabricated vacuum-manufactured expanded polystyrene bars 131. In FIG. 2, only a cross section of a hollow metal bar forming the perimeter structure 13 is shown, filled by a polystyrene bar 131.

According to the present example, the layers may be attached to the supporting structure 1 being fastened to the ribs 14, by means of, for example, screws, in such a way that a portion of the outer layers of the panel is left exposed.

Figure 3A:
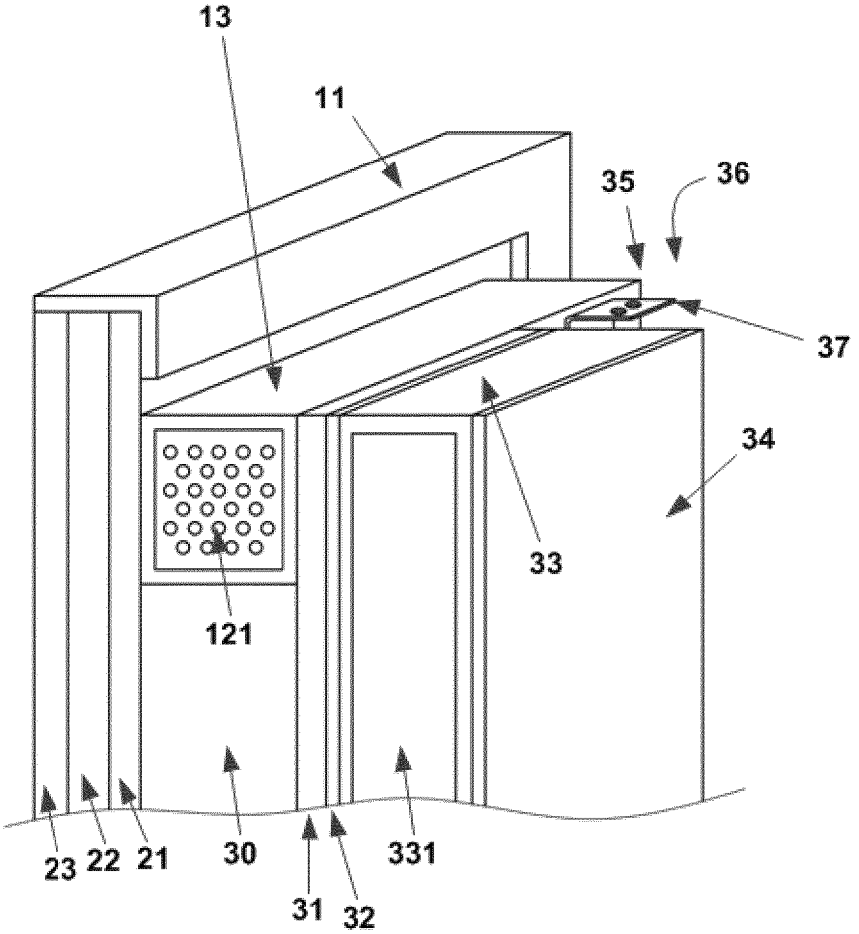
FIG. 3A shows a cross-section diagram of an example of a panel according to the present disclosure.

FIG. 3A shows a cross section perspective depiction of all the layers of the disclosed panel according to an example. More specifically, it shows a corner of the panel wherein the outer portion of the panel, e.g., of a building wall, is formed by the previously described perimeter frame 11, with OSB 21, thermal bridge break layer 22, and CBPB 23. On the opposite side of the perimeter structure 13 (and thus, of the supporting structure 1 shown in FIGS. 1 and 2), the following layers are attached, forming an inner portion of the panel: a second OSB 31, a vapor barrier layer 32, an omega-shaped profile 33, and a finishing plasterboard layer 34. Also, a rock wool layer may be placed filling up the space 30 defined between the OSBs 21 and 31 and the perimeter structure 13 and the ribs 14 of the supporting structure 1.

Figure 3B:
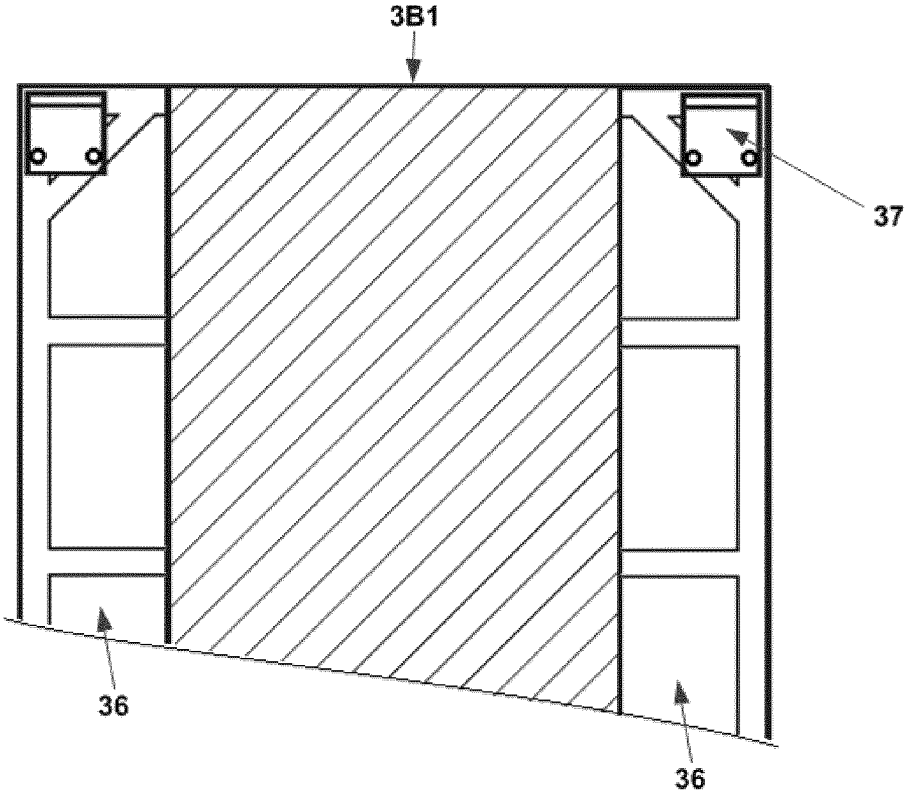
FIG. 3B shows a partial schematic diagram of the panel of FIG. 3A.

Furthermore, FIG. 3A also depicts the corner 35 of the panel. In this example, the perimeter structure 13 of the metal grid is longer along one of its dimensions than the layers of the inner portion of the panel, thus leaving an exposed side strip 36 on the inner layer of the panel. This is also depicted in FIG. 3B, wherein a central portion 3B1 of the panel is depicted to be narrower than the supporting structure 1, leaving two side strips 36 in the form of longitudinal sections. Also, the panel includes an anchor bracket 37 in each corner of the panel, which may be screwed to, for example, each corresponding rib of the supporting structure, which may be used to attach and fasten the panel to a pillar and/or beam of a building structure. Depending on the beams and pillars used on the building structure, more or less anchor brackets may be used in each panel. Furthermore, the strips 36 may be sized in order to match the size of the corresponding pillars or beams.

Also, according to this example, the outer layer of the panel is longer and wider than the metal grid, as it can be seen both in FIG. 2 and FIG. 3A, thus leaving a portion of the outer layer of the panel exposed (which may be used, for example, to cover beams and pillars when the panel is attached to a building structure). The manufacturing of panels according to examples of the present disclosure may be performed with a very high speed and efficiency in a manufacturing installation including several stations.

Figure 4:
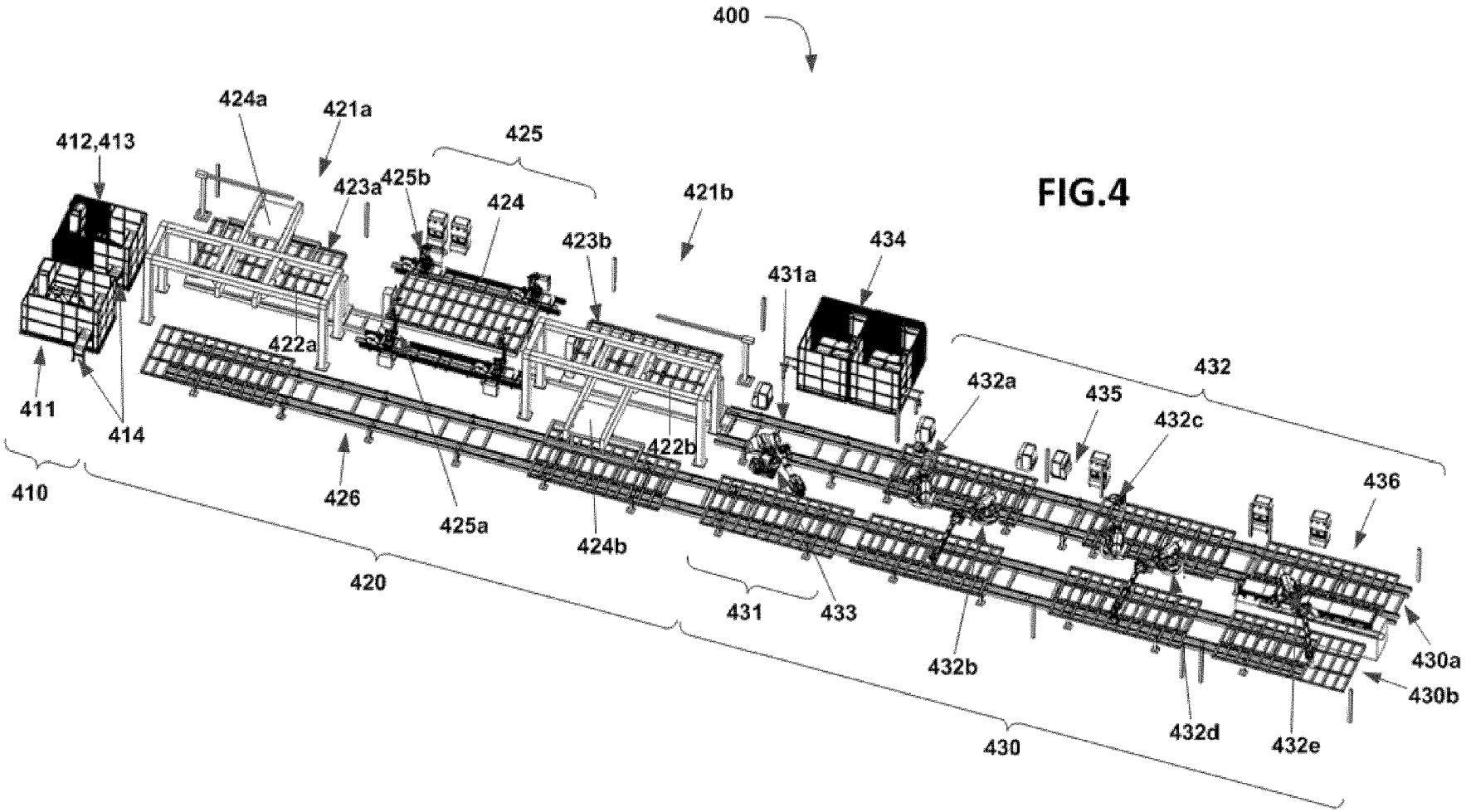
FIG. 4 shows in perspective a schematic installation for the manufacture of panels according to embodiments disclosed herein.

FIG. 4 shows the operational layout of an example of a manufacturing installation 400 for the manufacturing of layered panels according to embodiments of the present disclosure.

The installation 400 of FIG. 4 includes a first area 410 where metal bars are prepared and cut: a second area 420 where the supporting structure 1 of the panel is formed, by welding metal bars; a third area 430 where the layers of the outer portion of the panel are attached to one side of the supporting structure 1; and a fourth area 440 where the layers of the inner portion of the panel are attached to the other side of the supporting structure 1. The different areas may be aligned in a common line direction, as in FIG. 4, but they may also be arranged according to a different layout.

A non-limiting example of the stations or areas 410, 420, 430 and 440 and the operations performed in each of them to manufacture layered panels according to embodiments disclosed herein, will be described in more detail in the following.

Area 410

In a coating unit 411, hollow metal bars intended for the perimeter structure 13 and the ribs 14, as well as metal profiles intended to form the perimetral frame 11, may be coated with an anti-corrosive coat. This operation may be performed by a painting robot.

In a cutting unit 412 the hollow metal bars may be cut with a cutting laser tool, in order to obtain bars with the size and shape (such as diagonal cross-section cuts, etc. . . . ) to be assembled according to a predetermined layout, to form the perimeter structure 13 and the ribs 14 of the metal grid. This operation may be performed by a further robot with a cutting tool attached to its end effector.

The hollow metal bars may be filled with prefabricated vacuum-manufactured expanded polystyrene bars 131, the bars 131 having a square cross-section which assembles with the hollow bars, filling all the hollow space inside them, by a filling unit 413.

The metal bars may enter coating unit 411 and be transported on to subsequent unit on a conveyor 414.

Area 420

The welding area 420 includes in this example two inlets 421*a*, 421*b*, from which the metal tubes prepared in area 410 are fed into area 420, e.g., on pallets (not shown). In correspondence with each of the inlets 421*a*, 421*b* there is a supporting carriage 423*a* and 423*b*, displaceable along the line direction to reciprocate between a loading position 422*a*, 422*b*, in correspondence with the inlet 421*a* and 421*b*, and a working position 424 in a welding unit 425, which is common to both carriages 423*a* and 423*b*.

The welding unit 425 includes a number of welding robots 425*a*, 425*b*, etc., e.g., four welding robots, which may be arranged around the working position 424. The filled metal bars may be welded to each other by using, for example, a point-to-point welding, avoiding any type of welding involving the use of gas. Using a point-to-point welding may be a more sustainable option, avoiding the problems of gas-welding in an automated process. However, in the case that the robots may use a gas-based welding, each robot would normally carry its own gas tank, which would run out of gas at different times during the manufacturing process. Therefore, the overall manufacturing process may have to be stopped to fill the empty tank, which may force other robots to stop working, making the overall process slower and much more complicated. Hence, according to this example, the robots used in welding unit 425 may be robots using a point-to-point welding system in their end effectors.

Assembly operators (not shown) may manually load the metal tubes on each of the carriages 423*a* and 423*b*, which may be provided on their surface with a suitable template tool (not shown) to assist the operators in placing the tubes in the correct positions to form the metal grid including the perimeter structure 13 and ribs 14.

Each of carriages 423*a*, 423*b*, once metal tubes have been placed on it, is transferred to the working position 424, where the welding unit 425 welds together the tubes to form the metal grid, and then returned to their respective loading positions 422*a*, 422*b*, from where respective bridge cranes 424*a*, 424*b* empty the carriages 423*a*, 423*b* by picking the welded metal grid and transferring it to a conveyor 426.

The work on carriages 423*a* and 423*b* is done in an alternating mode: e.g., while carriage 423*a* is in the working position 424, carriage 423*b* is in the loading position 422*b*, and assembly operators are placing metal tubes on it. Once welding is completed on carriage 423*a*, this carriage returns to the loading position 422*a* and is emptied by the bridge crane 424*a*, while carriage 423*b*, with metal tubes prepared on it, travels from the loading position 422*b* to the working position 424, where the tubes are welded to form a new metal grid.

Conveyor 426 transfers downstream the line the completed metal grids for the panels, in the shape of a metal grid with a perimeter structure 13 and several ribs 14, formed by hollow metal tubes filled with a vacuum-manufactured expanded polystyrene bar.

More specifically, the metal grids are transported to the subsequent area 430 where the layers of the outer portion of the panel may be attached to one side of the supporting structure.

Area 430

The layer forming area 430 includes two assembly lines 430*a* and 430*b*, which may run parallel to each other. The operations performed in each line may be the same ones but performed in an alternate mode, in order to maximize the output of the overall assembly line and manufacture more panels per unit of time. The two assembly lines are disposed in such way that the assembled metal grids arrive through line 430*b* to an assembly unit 431, which has an assembly robot 432 which lifts an incoming metal grid from the conveyor 426 into a assemble position 431*a* in assembly line 430*a*, wherein assemble operators may place the layers forming the outer portion of the panel, e.g., of a building wall, on top of the metal grid. The layers may be placed by the operators in such way to be subsequently fastened to the metal grid in the next fastening unit 432, and they may be assembled and fastened with the previously welded perimeter frame 11, although the assembly of the perimeter frame 11 may be performed further down the assembly line by, for example, assembly operators. More specifically the following layers may be placed by the assembly operators, the assembly being performed in the following order:

an OSB 21, assembled with the perimeter frame 11;

a thermal bridge break layer 22, to decrease the flow of heat through the panel, the layer being attached to the OSB 21 by a plurality of staples;

a CBPB 23.

In this example, the prefabricated CBPBs 23 arrive from the manufacturer in single boards the size of the frames. The boards 23 may be cut according to a cutting layout beforehand, or, alternatively, a cutting station 434 may be used on-site, previous to assembly of the layers on to the supporting structure 1, wherein the CBPBs 23 are cut following a cutting layout which takes into account openings for doors and windows, cutting each board accordingly (or leaving it uncut, when no door or window opening is needed). According to the present example, the cutting station 434 may be operated by assembly operators, although, alternatively, a cutting robot (not shown) may also be used, the robot being in charge of cutting the CBPB and/or other layers of the panel, before the assembly of the layers. Furthermore, the cutting station may also be used by assembly operators to cut any other layer which may be subsequently assembled to the supporting structure 1.

Once the layers are assembled, the OSB 21 may be fastened with the perimeter frame 11 by screwing through the CBPB 23, thermal bridge break layer 22, OSB 21 and perimeter frame. Such operation may be performed by assembly operators working around the layer forming area 430.

After said assembly and fastening of the layers forming the outer portion of the panel, the supporting structure, with the perimeter frame and the three assembled layers, is moved along assembly line 430*a*. The same assembly of said elements to the supporting structure 1 may be made on assembly line 430*b*, while the already assembled supporting structure moves to the next unit, thus saving time performing in an alternating mode the same operations on both assembly lines 430*a*, 430*b*.

When a supporting structure 1 is assembled with said layers and the perimeter frame attached and fastened to the layers, it moves into a fastening unit 432, wherein a first fastening robot 432*a* attaches the assembled layers and the perimeter frame with the metal grid in the following way: the CBPB may be fastened to the metal grid, and consequently, also to the layers between the board and the supporting structure, by a plurality of screws. In this case, a plurality of screws may be threaded through the CBPB 23, the thermal bridge break layer 22, the OSB 21 and into the ribs 14 of the metal grid (to further fasten the layers to the metal grid). Furthermore, the CBPB may be leveled with the profile of the perimeter frame 11, in such a way that neither of them protrudes from the other. Also, the screws may be inserted in such a way that they do not protrude from the surface of the CBPB 23. This may be achieved, for example, by making a hole the size of the screw head partially into the CBPB 23. This way, when the screw is inserted, the head of the screw would not protrude, leaving the surface of the CBPB 23 with no protrusions. The gaps of the holes left between the hole and the screw may be plastered in order to leave a smooth surface of the CBPB 23.

Afterwards, a sealing of the layers may be performed by sealing robot 432*b*, sealing the joints found between the layers and the supporting structure 1 using a polyurethane-based filler.

After the sealing is performed, a plurality of exterior finishing layers may be applied to the CBPB 23 by assembly operators, although alternatively a further robot (not shown) may be used to apply the finishing. More specifically, said finishing layers may include, in this order:

a primer or undercoat layer, which is a preparatory coating put on the surface before painting. This layer seals the pores of the CBPB 23 (there are not many in an untouched part, but in the holes corresponding to the screws to attach the board 23 to the structure 1, pores may need to be sealed), ensures better adhesion of paint to the surface of the CBPB 23, increases paint durability, and provides additional protection against corrosion while covering the color of the CBPB 23. It also has a quick drying time.

a pigmented elastic coating for exterior surfaces, used as an intermediate coat in the smooth elastomeric cycle, to protect wall surfaces, and especially those subject to cracking or fissures. In a wall formed by several panels, the panels would have an elastic joint in between each other, in order to prevent cracks or fissures on the wall. However, such joints compensate small movements such as terrain movements, expansions or contractions of materials due to temperature changes, or other similar movements in a wall. In case of a bigger movement (such as, for example, an earthquake), the joints may not resist and keep the panels together, but the elastic coating would still prevent the appearance of micro fissures (of a size in between 1 mm and 3 mm) on the cement board, which affect the internal structure of the panel. Thus, the wall would have to be repaired, but the panels may be reused, fixing only the joints in between them. The product for such elastic coating may be, for example, the commercially available "ELASTRONG GUM" from the manufacturer "Oikos™". Such product contains acrylic elastomeric resins in water dispersion, organic and inorganic pigments and titanium dioxide. The special elastomeric resins make the product highly elastic, water repellent, resistant to light, to weather conditions and to pollution: it also prevents the formation of mold and algae. The product remains elastic over time, even when subject to frost and thaw cycles and U.V. rays. It is inflammable and is friendly to both humans and the environment.

a mate and elastic coating for exterior surfaces, such as the commercially available "ELASTRONG PAINT GUM™" from the manufacturer "Oikos™", coming in a variety of colors, making it suitable as a final exterior layer. The product contains acrylic elastomeric resins in water dispersion, giving to the product outstanding elasticity, weather-ability, water repellence, light stability and resistance to pollution. Furthermore, the product prevents the formation of mold and algae. When treating the surface with said coating, the vapor permeability is maintained, and it becomes easily washable. The product remains elastic over time, even when subject to frost thaw cycles and U.V. rays.

When the assembly and fastening of the layers of the outer portion of the panel has been performed, the panel may be flipped, either manually by assembly operators or by a turning robot (not shown) in such a way that the surface of the panel opposite to the outer portion (e.g., what will become the inner portion of the panel) face upwards, thus allowing the subsequent units of the assembly lines to assemble other layers and work on that surface. The place where the flipping takes place may be in the conveyor space 435 between robot 432*b* and robot 432*c*. Once flipped, both assembly lines 430*a* and 430*b* may alternatively move the assembled supporting structures (with the outer portion of the panel in place, inner portion facing upwards) to the part of unit 432 wherein fastening robot 432*c* is found. Then, the inner portion of the panel, e.g., of a building wall, may be formed by assembly operators assembling the following layers in the following order:

- rock wool layer 30: filling up the space defined by the OSB 21 and the height of the supporting structure 1. It is used to thermally insulate;
- a second OSB 31;
- a vapor barrier layer 32. Such layer is of any material used for damp proofing, typically a plastic or foil sheet, that resists diffusion of moisture through the wall, floor, ceiling, or roof assemblies of buildings to prevent interstitial condensation and of packaging. Technically, many of these materials are only vapor retarders as they have varying degrees of permeability. The layer may be attached as a self-glued layer to the OSB 31. An omega-shaped profile 33. The omega profile 33 defines an intermediate hollow space 331 in between the previous layer and the subsequent layer. Such hollow space 331 is filled with an insulating material such as, for example, rock wool or fiberglass. The quantity of filling material is calculated in such a way that the resulting wall maintains a linear temperature on the inside of a building. This calculation takes into account an average high and low exterior temperature and fixates a desired temperature on the inside of the building. For example, a quantity of fiberglass may be calculated in order to maintain a temperature on the inside of the building of between 22° and 24°, in an environment wherein the exterior temperature in the summer is an average of 40° C. and in the winter is an average of −40° C.

After the operators may have assembled the layers, the fastening robot 432*c* may fasten the layers accordingly, by nailing or screwing the profile 33, through the vapor barrier 32 and the OSB 31 and into the metal grid.

Furthermore, sealing robot 432*d* may also seal the joints found between the layers and the supporting structure 1 using a polyurethane-based filler, in a similar way as in the case of sealing robot 432*b*.

Afterwards, the corresponding conveyor (430*a* or 430*b*) may move the panel onwards towards fastening robot 432*e*. In such part of the conveyor 436, assembly operators assemble a finishing plasterboard layer on top of the omega-shaped profile. In this example, a commercially available plasterboard may be used known as "superplaca" from the manufacturer "Knauf™". Such board has the same composition as a regular plasterboard, but its manufacturing process makes it much denser than the usual commercially available plasterboard, thus rendering it harder, more resistant to cracks and fissures, and fireproof. After being assembled on top of the omega profile by the operators, the "superplaca" may be screwed to the omega profile 33 by the fastening robot 432*e*.

In order to finish it and further apply a finishing paint coat 34, the screws (which do not protrude from the surface of the plasterboard) may be filled with standard plasterboard filling material and painted with any suitable interior paint by the assembly operators after the plasterboard layer has been fastened to the omega profile.

Each of the robots in the manufacturing line of FIG. 4 or other manufacturing facility for a layered panel as disclosed in the examples of the present disclosure (e.g., welding robots, fastening robots such as screwing or riveting robots, sealing robots, etc. . . . ) may be an industrial robot, including at least three independently programmable axes. More specifically, for example, robots with four axes or six axes each, i.e., with six independently programmable degrees of freedom. Furthermore, the robots may include programmable rotation axes, linear axes, or other similar serial robots. When designing a panel, the thickness or density of any of the insulating layers (for example, the rock wool layer 30, the thermal bridge break layer 22, etc. . . . ), both in the inner and/or the outer portion of the panel, may be varied, in order to adapt the construction panel to different environments or weather conditions (depending on latitude, longitude, specific climates, etc. . . . ).

In addition to this, all the previous assembling can be performed with almost no drying waiting time involved, since all the layers may be prefabricated and ready to install or may be quick drying finishing layers.

Also, the combination of the supporting structure 1 and the threaded CBPB 23 renders a more solid and robust panel, i.e., earthquake resistant. Thus, the panels may be suitable to be used in emergency situations wherein a relatively fast construction of solid and cost-effective buildings is needed, such as post-natural disasters scenarios (i.e., earthquakes, tornadoes, tsunamis, etc. . . . ).

Once the panels are manufactured, they can be assembled to perform the construction of a building. In this case, according to the present example, when manufacturing the structure of the panels, a plurality of holes is drilled in the perimeter structure, following a predetermined layout. In this example, three pairs of holes may be drilled, each pair in the central part of three sides of the perimeter structure. This way, when the panel is erected in order to form a wall, the pairs of holes may be found in the lateral sides of the perimeter structure, and the upper perimeter side of the structure, corresponding to the ceiling of the floor of the building.

On the other hand, a building skeleton may be erected formed by beams and columns. The beams and columns are attached to each other by means of an intersection piece which bears holes, which correspond to holes found on the ends of the columns and beams. This way, the structure can be formed by screwing the columns and beams with each other by means of the intersection pieces. Furthermore, the beams and columns corresponding to lateral columns and ceiling beams may also have carved areas for receiving connecting plates, the carved areas having corresponding pairs of holes as in the holes found in the perimeter structure of the panels. Thus, the panels may be attached to the building skeleton by means of connecting plates screwed both into the panel and to the corresponding columns and beams.

A screwed attaching of the panels to the building skeleton assures that no welding or rigid attachment is needed to form walls within a building, thus making the overall building more resistant to movements related to, for example, the settlement of the building, or natural disasters such as earthquakes or tornados. It also assures a simple and fast on-site construction process of the building, needing only screwing tools and plates to form the walls of the building.

As a finishing insulation, the gaps found in between panels and the building skeleton or other panels may be covered by placing a rubber band or layer in between the panels and the columns, beams or other perimeter structures of adjacent panels. Such rubber bands may come from pre-manufactured rolls of, for example, polyurethane-based auto-adhesive bands, thus facilitating an easy and fast attachment in the gaps, in order to fully insulate the inside areas of the building.

Furthermore, the present disclosure includes examples according to the following clauses:

Clause 1. A layered panel for on-site modular construction of buildings, the panel including:

a layer formed by a prefabricated cement-bonded particle board;

a supporting structure including a metal grid and a perimeter frame, the perimeter frame being configured to receive and surround the cement-bonded particle board; and fastening elements attaching the cement-bonded particle board to the supporting structure.

Clause 2. The panel according to clause 1, wherein the fastening elements attach the cement-bonded particle board to the supporting structure by threading, and may include screws that are inserted through holes in the metal grid and threaded into the cement-bonded particle board.

Clause 3. The panel according to any of clauses 1 or 2, wherein the fastening elements attach the cement-bonded particle board to the supporting structure by threading, and may include screws that are inserted through holes in the perimeter frame and threaded into the cement-bonded particle board.

Clause 4. The panel according to any of clauses 1 to 3, further including an outermost layer and an innermost layer on opposite sides of the supporting structure, and wherein the cement-bonded particle board is placed on the outermost layer.

Clause 5. The panel according to clause 4, wherein the innermost layer includes at least one insulating layer and a finishing layer.

Clause 6. The panel according to any of clauses 4 or 5, wherein the innermost layer overlaps only partially with the supporting structure and the outermost layer.

Clause 7. The panel according to clause 6, wherein the innermost layer has a smaller surface area than the outermost layer such that it overlaps a central portion of the supporting structure and the outermost layer, while at least two side strips of the supporting structure and the outermost layer remain exposed.

Clause 8. The panel according to clause 7, further including mounting brackets attached to the supporting structure in correspondence with the exposed side strips.

Clause 9. The panel according to clause 5, wherein the insulating layer is a thermal bridge break layer.

Clause 10. The panel according to any of clauses 1 to 9, wherein the cement-bonded particle board is a single piece with a shape and dimension to fit the perimeter frame.

Clause 11. The panel according to any of clauses 1 to 10, wherein at least part of the metal grid includes hollow tubular members filled with a vacuum-manufactured expanded polystyrene bar.

Clause 12. The panel according to any of clauses 4 to 11, wherein the innermost layer of the panel further includes tubing and tubing connectors for water installations and/or electrical installations and/or heating installations.

Clause 13. A method for manufacturing a layered panel according to any of clauses 1 to 12, the method including:

manufacturing a supporting structure including a metal grid and a perimeter frame;

cutting a prefabricated cement-bonded particle board according to a predetermined layout;

assembling the cut cement-bonded particle board inside the perimeter frame of the manufactured supporting structure and fastening the cement-bonded particle board to the manufactured supporting structure.

Clause 14. An installation for manufacturing a layered panel according to any of clauses 1 to 12, the installation including:

a station to form a supporting structure including a metal grid and a perimeter frame;

a station for cutting a prefabricated cement-bonded particle board according to a predetermined layout;

a station to receive a supporting structure and a prefabricated cement-bonded particle board from the previous stations, and for assembling the cement-bonded particle board inside the perimeter frame of the supporting structure and fastening the board to the supporting structure.

Clause 15. The installation according to clause 14 wherein the metal grid includes hollow tubular members and the station to form a supporting structure includes a unit for inserting a vacuum-manufactured expanded polystyrene bar inside a hollow tubular member of the metal grid.

Clause 16. A method for the construction of buildings with layered panels according to any of clauses 1 to 12, including:

erecting a building skeleton including load-bearing columns and beams: and forming at least outer walls of the building by attaching layered panels according to any of clauses 1 to 12 to columns and/or beams of the skeleton, and optionally to other panels, with screws and/or rivets.

Clause 17. A method for the construction of buildings according to clause 16, further including:

arranging an installation according to any of clauses 14 or 15 in shipping containers;

transporting the shipping containers to a desired building site;

deploying the stations of the installation from the shipping containers at the desired building site;

operating the stations of the installation to manufacture layered panels; and constructing buildings with the layered panels at the desired building site.

Clause 18. The method according to clause 17, wherein at least one station of the installation is arranged inside one container according to an operational layout, whereby the station may be substantially deployed by removing at least part of the container walls.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples but should be determined only by a fair reading of the claims that follow. If reference signs related to drawings are placed in parentheses in a claim, they are solely for attempting to increase the intelligibility of the claim and shall not be construed as limiting the scope of the claim.

The invention claimed is:

1. A layered panel for on-site modular construction of buildings, the layered panel comprising:

a layer formed by a prefabricated cement-bonded particle board, the prefabricated cement-bonded particle board being a composite board comprising wood particles or other natural fibers and a mineral bonding agent;

a supporting structure comprising a metal grid and a perimeter frame, the perimeter frame being configured to receive and surround the prefabricated cement-bonded particle board, and the metal grid and the perimeter frame being attached to each other;

fastening elements attaching the prefabricated cement-bonded particle board to the supporting structure; and an outermost layer and an innermost layer on opposite sides of the supporting structure, wherein the prefabricated cement-bonded particle board is the outermost layer, and wherein the innermost layer overlaps only partially with the supporting structure and the outermost layer.

2. The layered panel according to claim 1, wherein the fastening elements attach the prefabricated cement-bonded particle board to the supporting structure by threading, and wherein the fastening elements comprise screws that are inserted through holes in the metal grid and threaded into the prefabricated cement-bonded particle board.

3. The layered panel according to claim 1, wherein the fastening elements attach the prefabricated cement-bonded particle board to the supporting structure by threading, and wherein the fastening elements comprise screws that are inserted through holes in the perimeter frame and threaded into the prefabricated cement-bonded particle board.

4. The layered panel according to claim 1, wherein the innermost layer comprises at least one insulating layer and a finishing layer.

5. The layered panel according to claim 1, wherein the innermost layer has a smaller surface area than the outermost layer such that it overlaps a central portion of the supporting structure and the outermost layer, while at least two side strips of the supporting structure and the outermost layer remain exposed.

6. The layered panel according to claim 5, further comprising mounting brackets attached to the supporting structure in correspondence with the exposed side strips.

7. The layered panel according to claim 4, wherein the insulating layer is a thermal bridge break layer.

8. The layered panel according to claim 1, wherein the prefabricated cement-bonded particle board is a single piece with a shape and dimension to fit the perimeter frame.

9. The layered panel according to claim 1, wherein at least part of the metal grid comprises hollow tubular members filled with a vacuum-manufactured expanded polystyrene bar.

10. A method for manufacturing the layered panel according to claim 1, the method comprising:

manufacturing the supporting structure comprising the metal grid and the perimeter frame;

cutting the prefabricated cement-bonded particle board according to a predetermined layout;

assembling the cut prefabricated cement-bonded particle board inside the perimeter frame of the manufactured supporting structure; and fastening the cut prefabricated cement-bonded particle board to the manufactured supporting structure.

11. A method for construction of buildings with layered panels according to claim 1, the method comprising:

erecting a building skeleton comprising load-bearing columns and beams; and forming at least outer walls of the building skeleton by attaching the layered panels to columns and/or beams of the building skeleton, and to other layered panels, with screws and/or rivets.

12. The method according to claim 11, further comprising:

arranging in shipping containers an installation for manufacturing the layered panel, the installation comprising a first station to form the supporting structure comprising the metal grid and the perimeter frame, a second station for cutting the prefabricated cement-bonded particle board according to a predetermined layout, and a third station to receive the supporting structure and the prefabricated cement-bonded particle board from the first station and the second station, and for assembling the prefabricated cement-bonded particle board inside the perimeter frame of the supporting structure and fastening the prefabricated cement-bonded particle board to the supporting structure;

transporting the shipping containers to a desired building site;

deploying the first, second, and third stations of the installation from the shipping containers at the desired building site;

operating the first, second, and third stations of the installation to manufacture the layered panels; and constructing the buildings with the layered panels at the desired building site.

* * * * *